US006926138B1

(12) United States Patent
Basham et al.

(10) Patent No.: US 6,926,138 B1
(45) Date of Patent: Aug. 9, 2005

(54) BOTTLE CAP INCLUDING AN ADDITIVE DISPENSER

(76) Inventors: Mark Floyd Basham, 205 W. Mink, Willis, TX (US) 77378; Kenny Lee Baxter, 4439 Shadow-Glen Dr., Dallas, TX (US) 75287

( * ) Notice: Subject to any disclaimer, the term of this patent is extended or adjusted under 35 U.S.C. 154(b) by 145 days.

(21) Appl. No.: 10/642,535

(22) Filed: Aug. 18, 2003

(51) Int. Cl.[7] ..... B65D 25/08
(52) U.S. Cl. ..... 206/222; 206/219; 215/DIG. 8
(58) Field of Search ..... 206/217, 219, 206/222; 215/DIG. 8, 228, 262; 220/212, 359.1; 222/83, 129, 630

(56) References Cited

U.S. PATENT DOCUMENTS

| | | | | |
|---|---|---|---|---|
| 4,024,952 A | | 5/1977 | Leitz | |
| 5,322,094 A | * | 6/1994 | Janesko | 141/65 |
| D382,170 S | | 8/1997 | Green | |
| 5,692,644 A | * | 12/1997 | Gueret | 222/80 |
| 5,941,380 A | | 8/1999 | Rothman | |
| 5,992,666 A | * | 11/1999 | Wu | 220/212 |
| 6,152,296 A | | 11/2000 | Shih | |
| 6,170,654 B1 | | 1/2001 | Gartner et al. | |
| 6,230,884 B1 | | 5/2001 | Coory | |
| RE38,067 E | * | 4/2003 | Gueret | 206/222 |
| 2003/0197011 A1 | * | 10/2003 | Nieh et al. | 220/231 |
| 2003/0213709 A1 | * | 11/2003 | Gibler et al. | 206/219 |
| 2004/0020797 A1 | * | 2/2004 | Fontana | 206/219 |

FOREIGN PATENT DOCUMENTS

FR 2 722 765 * 1/1996

* cited by examiner

*Primary Examiner*—David T. Fidei

(57) ABSTRACT

A cap includes a plunger member including a cavity portion integral therewith and extending downwardly therefrom. The cavity portion is capable of containing additive therein and includes a lower portion having an opening for dispensing the additive into the container. A receiving member receives the plunger member and includes a threaded portion for engaging a container. A spring member is preferably disposed between the cavity portion and a neck portion and becomes compressed when the plunger member is moved towards a down position. A membrane preferably extends across an opening of a container and engages the opening of the cavity portion when the plunger member is at an up position. The membrane may be formed from aluminum foil so that it can be penetrated when the plunger member is moved to a down position and to thereby allow the opening of the cavity to pass therebelow so that the additive can be introduced into a container.

20 Claims, 2 Drawing Sheets

BOTTLE CAP INCLUDING AN ADDITIVE DISPENSER

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a bottle cap and, more particularly, to a bottle cap including an additive dispenser for introducing the additive into a container.

2. Prior Art

Different styles of caps or lids for containers (for liquids) are prolific. They are known in a variety of forms, which can include, for example: a tamper-evident ring; the ability to be re-sealable; a screw thread; or a combination of these. Such caps also include those that can be drunk through and resealed ("sipper tops"), either with or without a screw thread, so that the container is re-usable.

Drinks and drink containers where two components making the drink are best mixed immediately before drinking are available separately. However for some types of drinks, where the concentrate is in tablet or powder form, the availability of drinks with all elements for the drink in the one container are rare and hard to find commercially.

Furthermore, food and drug manufacturers market many concentrated products, e.g., powdered drinks and granulated medications which consumers add to a liquid after purchase. These food and drug products are typically sold in packets, jars, cans, and other similar packages, either in bulk or single size servings. It is easy to dispense a serving of powdered flavor concentrate or a dose of granulated medicine from any of those packages into a glass of water or other liquid; however, servings or doses cannot quickly, easily, neatly, and completely be dispensed from those packages directly into a typical narrow necked 16 oz. or 1.5 liter bottle of water or other liquid.

BRIEF SUMMARY OF THE INVENTION

In view of the foregoing background, it is therefore an object of the present invention to provide a bottle cap for simply and effectively dispensing an additive into a cavity of a container. These and other objects, features, and advantages of the invention are provided by a cap for removably engaging a top opening of a container and including a plunger member including a substantially centrally disposed cavity portion integral therewith and extending downwardly therefrom. The cavity portion is capable of containing additive therein and is provided with a lower portion having an opening for dispensing the additive into the container.

The cavity portion may include an outer surface that converges downwardly towards the membrane so that the opening of the cavity portion is preferably narrower than an opening of the container. The plunger member further includes a neck portion integral therewith and spaced from the cavity portion. The plunger member may include a top surface having a substantially arcuate shape.

The present invention further includes a receiving member for receiving the plunger member and has a notch portion integral therewith for engaging the neck portion and guiding same substantially vertically between up and down positions. The notch portion preferably extends around a perimeter of the receiving member. The receiving member further includes a threaded portion integral with the notch portion and is disposed therebelow. The threaded portion is removably engageable with an opening of a container so that the cap can become effectively attached to same. Notably, the lower portion of the cavity portion is preferably disposed below the notch portion.

The present invention further includes a spring member preferably disposed between the cavity portion and the neck portion. The spring member becomes compressed when the plunger member is moved towards a down position. The spring member causes the plunger member to move towards an up position after being released and is preferably disposed above the notch portion.

The present invention further includes a membrane preferably extending across an opening of a container and engaging the opening of the cavity portion. The membrane may be formed from aluminum foil so that it can be penetrated when the plunger member is moved to a down position and to thereby allow the opening of the cavity to pass therebelow so that an additive can be introduced into a container.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art.

Figure 1:
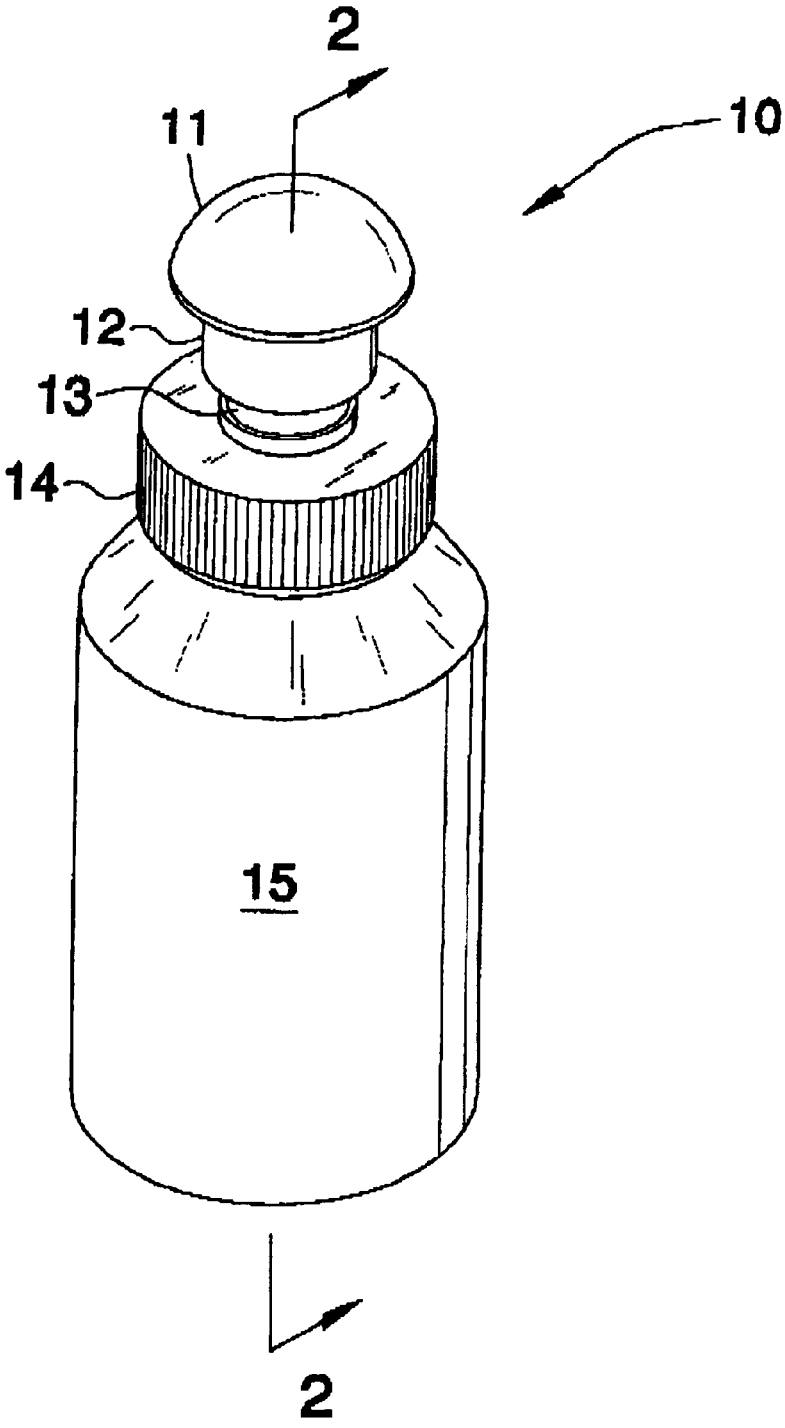
FIG. 1 is a perspective view of a cap including an additive dispenser and being attached to a container, in accordance with the present invention.

The apparatus of this invention is referred to generally in FIG. 1 by the reference numeral 10 and is intended to provide a cap which, when combined with an appropriate container 15, permits two elements of a drink to be separately contained within the one container 15 and mixed immediately before the user desires the drink. It should be understood that the cap 10 may be used to dispense a variety of additives 17 and should not be construed as dispensing only powder additives 17, for example. For the purposes of this specification, the term "cap" is used to describe any lid or cap or closure for a container or bottle 15 with a top opening. Also, the term "container" is used to cover any vessel with a top opening, which is capable of carrying or retaining a liquid 23, regardless of the material of which it is made.

Figure 2:
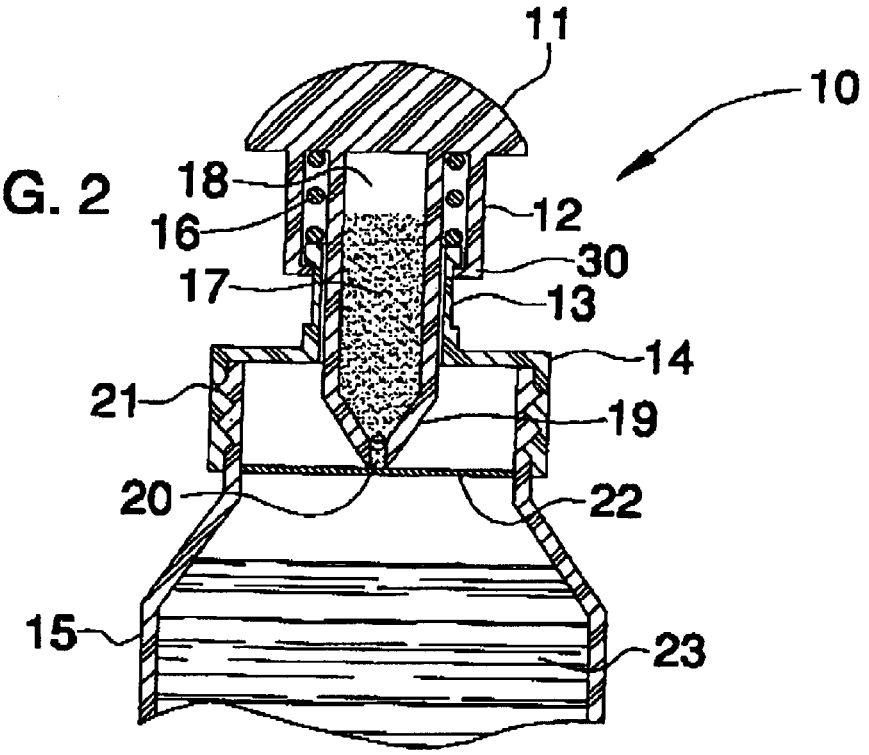
FIG. 2 is a cross-sectional view taken along line 2—2 in FIG. 1, when the cap is at an up or uncompressed position.
Figure 3:
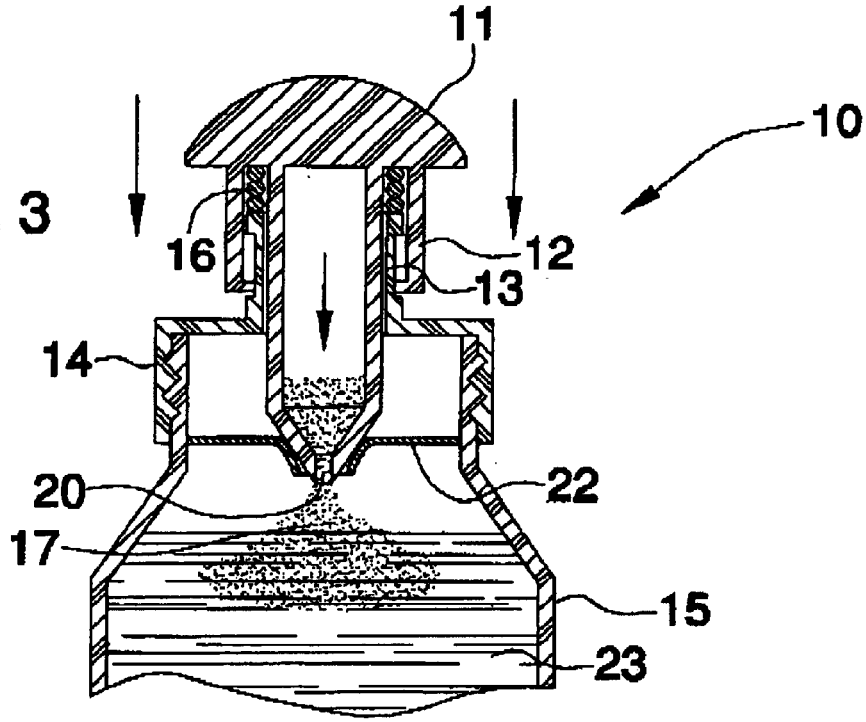
FIG. 3 is a cross-sectional view taken along line 2—2 in FIG. 1, when the cap is at a down or compressed position.

Referring to FIGS. 2 and 3, the cap 10 includes a plunger member 11 including a substantially centrally disposed cavity portion 18 integral therewith and extending downwardly therefrom. Such a cavity portion 18 is capable of containing an additive 17 therein and is provided with a lower portion 19 having an opening 20 for dispensing the additive 17 into the container 15. As noted above, additive 17 may be a liquid, powder or tablet(s), for example, as well know in the industry.

The cavity portion 18 may include an outer surface that converges downwardly towards a membrane 22 so that the opening 20 of the cavity portion 18 is preferably narrower than a top opening of the container 15. The membrane 22 prevents the additive 17 from being prematurely introduced into the container 15. The plunger member 11 further includes a neck portion 12 integral therewith and spaced from the cavity portion 18. The plunger member 11 may include a top surface having a substantially arcuate shape, as clearly shown.

A receiving member 14 receives the plunger member 11 and has a notch portion 13 integral therewith and for engaging the neck portion 12 and guiding same substantially vertically between up and down positions. The notch portion 13 preferably extends around a perimeter of the receiving member 14 for guiding the neck portion 12 thereabout. In particular, the neck portion 12 includes a lip portion 30 around a lower perimeter thereof for slidably engaging the notch portion 13 as the plunger member 11 is moved between up and down positions.

The receiving member 14 further includes a threaded portion 21 integral with the notch portion 13 and disposed therebelow. The threaded portion 21 is removably engageable with a top portion of the container 15 so that the cap 10 can become effectively attached to same. Notably, the lower portion 19 of the cavity portion 18 is preferably disposed below the notch portion 13.

A conventional spring member 16 such as a helical spring, for example, is preferably disposed between the cavity portion 18 and the neck portion 12. The spring member 16 becomes compressed when the plunger member 11 is moved towards a down position. The spring member 16 causes the plunger member 11 to move towards an up position after being released and is preferably disposed above the notch portion 13.

A membrane 22 preferably extends across the top opening of the container 15 and engages the opening 20 of the cavity portion 18. The membrane 22 may be formed from aluminum foil or other suitable material, well known in the industry, so that it can be penetrated when the plunger member 11 is moved to a down position to thereby allow the opening 20 of the cavity portion 18 to pass therebelow and disperse the additive 17 into the container 15. After such an additive 17 is dispersed into the container 15, a user can simply shake same to dissolve the additive 17 with the liquid 23 such as water, for example.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what is desired to secure by Letters Patent of the United States is:

1. A cap for removably engaging a top opening of a container and comprising:

a plunger member including a substantially centrally disposed cavity portion integral therewith and extending downwardly therefrom, said cavity portion for containing an additive therein and being provided with a lower portion provided with an opening for dispensing an additive in a container, said plunger member further including a neck portion integral therewith and spaced from said cavity portion;

a receiving member for receiving said plunger member and having a notch portion integral therewith for engaging said neck portion and guiding same substantially vertically between up and down positions, said receiving member further including a threaded portion integral with said notch portion and disposed therebelow, said threaded portion being removably engageable with an opening of a container so that said cap can become effectively attached to same;

a spring member disposed between said cavity portion and said neck portion, said spring member being compressed when said plunger member is moved towards a down position, said spring member causing said plunger member to move towards an up position after being released; and a membrane extending across an opening of a container and engaging the opening of said cavity portion, said membrane being penetrated when said plunger member is moved to a down position and thereby allowing the opening of said cavity to pass therebelow so that an additive will pass therethrough and become introduced into a container.

2. The cap of claim 1, wherein said cavity portion includes an outer surface converging downwardly towards said membrane.

3. The cap of claim 1, wherein the opening of said cavity portion is narrower than an opening of a container.

4. The cap of claim 1, wherein said spring member is disposed above said notch portion.

5. The cap of claim 1, wherein said plunger member includes a top surface having a substantially arcuate shape.

6. The cap of claim 1, wherein said notch portion extends around a perimeter of said receiving member.

7. The cap of claim 1, wherein said membrane is formed from aluminum foil.

8. The cap of claim 1, wherein said lower portion of said cavity portion is disposed below said notch portion.

9. A cap for removably engaging a top opening of a container and comprising:

a plunger member including a substantially centrally disposed cavity portion integral therewith and extending downwardly therefrom, said cavity portion for containing an additive therein and being provided with a lower portion provided with an opening for dispensing an additive in a container, said plunger member further including a neck portion integral therewith and spaced from said cavity portion;

a receiving member for receiving said plunger member and having a notch portion integral therewith for engaging said neck portion and guiding same substantially vertically between up and down positions, said receiving member further including a threaded portion integral with said notch portion and disposed therebelow, said threaded portion being removably engageable with an opening of a container so that said cap can become effectively attached to same;

a spring member disposed between said cavity portion and said neck portion, said spring member being compressed when said plunger member is moved towards a down position, said spring member causing said plunger member to move towards an up position after being released; and a membrane extending across an opening of a container and engaging the opening of said cavity portion, said membrane being penetrated when said plunger member is moved to a down position and thereby allowing the opening of said cavity to pass therebelow so that an additive will pass therethrough and become introduced into a container;

said cavity portion includes an outer surface converging downwardly towards said membrane.

10. The cap of claim 9, wherein the opening of said cavity portion is narrower than an opening of a container.

11. The cap of claim 9, wherein said spring member is disposed above said notch portion.

12. The cap of claim 9, wherein said plunger member includes a top surface having a substantially arcuate shape.

13. The cap of claim 9, wherein said notch portion extends around a perimeter of said receiving member.

14. The cap of claim 9, wherein said membrane is formed from aluminum foil.

15. The cap of claim 9, wherein said lower portion of said cavity portion is disposed below said notch portion.

16. A cap for removably engaging a top opening of a container and comprising:

a plunger member including a substantially centrally disposed cavity portion integral therewith and extending downwardly therefrom, said cavity portion for containing an additive therein and being provided with a lower portion provided with an opening for dispensing an additive in a container, the opening of said cavity portion being narrower than an opening of a container, said plunger member further including a neck portion integral therewith and spaced from said cavity portion;

a receiving member for receiving said plunger member and having a notch portion integral therewith for engaging said neck portion and guiding same substantially vertically between up and down positions, said receiving member further including a threaded portion integral with said notch portion and disposed therebelow, said threaded portion being removably engageable with an opening of a container so that said cap can become effectively attached to same;

a spring member disposed between said cavity portion and said neck portion, said spring member being compressed when said plunger member is moved towards a down position, said spring member causing said plunger member to move towards an up position after being released, said spring member being disposed above said notch portion; and a membrane extending across an opening of a container and engaging the opening of said cavity portion, said membrane being penetrated when said plunger member is moved to a down position and thereby allowing the opening of said cavity to pass therebelow so that an additive will pass therethrough and become introduced into a container;

said cavity portion includes an outer surface converging downwardly towards said membrane.

17. The cap of claim 16, wherein said plunger member includes a top surface having a substantially arcuate shape.

18. The cap of claim 16, wherein said notch portion extends around a perimeter of said receiving member.

19. The cap of claim 16, wherein said membrane is formed from aluminum foil.

20. The cap of claim 16, wherein said lower portion of said cavity portion is disposed below said notch portion.

* * * * *